US006267563B1

(12) United States Patent
Yamada et al.

(10) Patent No.: US 6,267,563 B1
(45) Date of Patent: Jul. 31, 2001

(54) VARIABLE CAPACITY TYPE COMPRESSOR WITH INCLINED CAPACITY CONTROL VALVE

(75) Inventors: Kiyohiro Yamada; Masahiro Kawaguchi; Kazuya Kimura; Shingo Kumazawa, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/483,841

(22) Filed: Jan. 17, 2000

(30) Foreign Application Priority Data

Jan. 18, 1999 (JP) ..... 11-009734

(51) Int. Cl.[7] ..... F04B 1/26
(52) U.S. Cl. ..... 417/222.2
(58) Field of Search ..... 417/222.2, 269; 92/71

(56) References Cited

U.S. PATENT DOCUMENTS

| | | | | |
|---|---|---|---|---|
| 3,062,020 | | 11/1962 | Heidorn | 62/196 |
| 6,048,178 | * | 3/2000 | Kawaguchi et al. | 417/222.2 |
| 6,056,513 | * | 5/2000 | Kawaguchi et al. | 417/222.2 |
| 6,135,722 | * | 10/2000 | Kawaguchi et al. | 417/222.2 |
| 6,139,282 | * | 10/2000 | Ota et al. | 417/222.2 |
| 6,142,745 | * | 11/2000 | Kawaguchi et al. | 417/222.2 |
| 6,146,107 | * | 11/2000 | Kawaguchi et al. | 417/222.2 |

FOREIGN PATENT DOCUMENTS

| | | |
|---|---|---|
| 0 748 937 A | 12/1996 | (EP) . |
| 62 298671 | 12/1987 | (JP) . |
| 8-338364 | 12/1996 | (JP) . |

OTHER PUBLICATIONS

EP 00 10 0263 Search Report dated Nov. 10, 2000.

* cited by examiner

*Primary Examiner*—Teresa Walberg
*Assistant Examiner*—Vinod D. Patel
(74) *Attorney, Agent, or Firm*—Woodcock Washburn Kurtz Mackiewicz & Norris LLP

(57) ABSTRACT

A variable capacity type compressor includes a swash plate and pistons to effect compressing action. The tilting position of the swash plate is controlled by the pressure in a control pressure chamber into which a coolant in the discharge pressure region is introduced. The pressure in the control pressure chamber is controlled by a capacity control valve mounted to the rear housing in an inclined position relative to a plane perpendicular to the axis of the rotatable drive shaft.

7 Claims, 8 Drawing Sheets

VARIABLE CAPACITY TYPE COMPRESSOR WITH INCLINED CAPACITY CONTROL VALVE

BACKGROUND OF THE INVENTION

1. Field of the Invention

The present invention relates to a structure for mounting a capacity control valve to a variable capacity type compressor in which a coolant is discharged from cylinder bores into a discharge chamber in a rear housing by reciprocating movements of pistons in the cylinder bores and is sucked from a suction chamber in the rear housing into the cylinder bores, while adjusting the pressure in a control pressure chamber, by the capacity control valve, to control the discharge capacity of the compressor.

2. Description of the Related Art

In a variable capacity type compressor disclosed in Japanese Unexamined Patent Publication (Kokai) No. 8-338364, the discharge capacity is changed in accordance with a difference between the pressure in a crank chamber and a suction pressure in a suction pressure zone. The pressure in the crank chamber is adjusted by introducing the coolant from the discharge chamber as a discharge pressure zone to the crank chamber and delivering the coolant from the crank chamber to the suction chamber as a suction pressure zone. A solenoid valve for controlling the discharge capacity is provided in a pressure supply passage for supplying the coolant from the discharge chamber into the crank chamber. A valve element of the solenoid valve is biased to the valve-closing position when a solenoid is energized. It is adapted that a value of electric current fed to the solenoid valve is selected based on the comparison of a predetermined compartment temperature with a detected compartment temperature. The greater the difference between the predetermined compartment temperature and the detected compartment temperature, the greater the current value to be fed, whereby the degree of opening of the solenoid valve decreases. The smaller the degree of opening, the greater the inclination angle of a swash plate, whereby the discharge capacity increases.

The capacity controlling solenoid valve is mounted to a rear housing having the suction chamber and the discharge chamber formed therein, and is arranged to extend outward from the circumferential wall of the rear housing, and such an arrangement obstructs the mounting of the compressor to an object to which the compressor is to be mounted. Particularly, when the compressor is mounted to a vehicle as part of an air-conditioner, there is a limitation in space usable for mounting the compressor, so it is required that the outward extension of the solenoid valve from the circumferential wall of the rear housing is minimized.

SUMMARY OF THE INVENTION

An object of the present invention is to provide a variable capacity type compressor in which an outward extension of a volumetric control valve from a circumferential wall of a rear housing can be minimized.

To achieve the above-mentioned object, according to the present invention, there is provided a variable capacity type compressor comprising: a body comprising a cylinder block having cylinder bores, and a rear housing attached to said cylinder block and having a discharge chamber and a suction chamber for communication with said cylinder bores, said rear housing having a circumferential wall and an outer end surface on the side opposite from said cylinder block;

pistons reciprocatingly arranged in the cylinder bores so that the movement of said piston toward said rear housing causes the coolant to be discharged from said cylinder bore into said discharge chamber and the movement of said piston away from said rear housing causes the coolant to be sucked from said suction chamber to said cylinder bore; a rotatable drive shaft having an axis; a motion transmitting device driven by said drive shaft for converting the rotational movement of the drive shaft into the reciprocating movement of the pistons; a control pressure chamber connected to a discharge pressure region by a coolant supply passage and to a suction pressure region by a coolant outlet passage; and a capacity control valve mounted to the rear housing in an inclined position relative to a plane perpendicular to the axis of the rotatable drive shaft, said capacity control valve being arranged in one of said coolant supply passage and said coolant outlet passage to control the pressure in said control pressure chamber to thereby control the capacity of said compressor.

Such an inclined arrangement of the capacity control valve is effective for restricting the outward extension of the capacity control valve out of the circumferential wall.

Preferably, the variable capacity type compressor, further comprises a mounting member provided integral with, or on, said rear housing for mounting said compressor to an object to which said compressor is to be mounted, said mounting member being arranged along the outer end surface of said rear housing, said capacity control valve having a proximal end located near said circumferential wall of said rear housing and a distal end located close to the axis of the rotatable drive shaft, said capacity control valve being inclined so that the distance from said distal end to the outer end surface of said rear housing is greater than the distance from said proximal end to the outer end surface of said rear housing, and intersecting said mounting member, as viewed in the direction of the axis of said rotatable drive shaft.

An amount of insertion of the capacity control valve into the rear housing increases due to the structure allowing the capacity volumetric control valve to intersect the mounting member. This structure contributes to suppress the extension of the capacity control valve out of the circumferential wall of the rear housing.

Preferably, said mounting member perpendicularly intersects said axis of said rotatable drive shaft and a part of said capacity control valve is arranged under said mounting member.

The mounting member intersecting the axis of rotation at a right angle divides the outer end surface of the rear housing into generally equal two portions. Such a mounting member dividing the outer end surface of the rear housing into the generally two portions makes it particularly difficult to provide a sufficient space for inserting the capacity control valve into the rear housing. The inclined arrangement of the capacity control valve is effective for providing a sufficient space for inserting the capacity control valve into the rear housing with the mounting member intersecting the axis of rotation at a right angle.

Preferably, the variable capacity type compressor further comprises a straight coolant suction passage arranged in the rear housing and connected to the suction chamber, said coolant suction passage being arranged on one side of said mounting member, said capacity control valve being arranged on the other side of said mounting member.

Preferably, said suction chamber is formed at a radially central region in the rear housing and said discharge chamber encircles said suction chamber, and wherein said capacity control valve comprises a valve member, an electrical drive means for said valve member, and a pressure sensitive device having a pressure sensitive chamber communicating with said suction chamber, and a pressure sensitive member displaceable in response to the pressure variation in said pressure sensitive chamber, said pressure sensitive device being arranged on the side of said distal end of said capacity control valve, said pressure sensitive device functioning so that the pressure in said pressure sensitive chamber converges to a pressure value corresponding to the driving force of said electrical drive means. The electrical drive means preferably comprises a solenoid.

The inclined arrangement of the volumetric control valve allows the distal end of the volumetric control valve to largely extend into the suction chamber and a pressure-sensitive opening, which communicates the pressure-sensitive chamber with the suction chamber, to enlarge. Such an enlarged pressure-sensitive opening enhances the sensitivity of the pressure-sensitive means.

Preferably, the variable capacity type compressor further comprises a front housing attached to said cylinder block on the side opposite from said rear housing, said front housing and said cylinder block forming said control pressure chamber, said motion transmitting device comprising a swash plate arranged in said control pressure chamber and axially movably and tiltably attached to said rotatable drive shaft, a rotor attached to said rotatable drive shaft and hinged to said swash plate to allow the swash plate to rotate with the rotatable drive shaft, and shoes arranged between the swash plate and the pistons.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

The first embodiments of the present invention will now be described in more detail with reference to FIGS. 1 to 7, which shows a variable capacity type compressor mounted to a vehicle.

Figure 2:
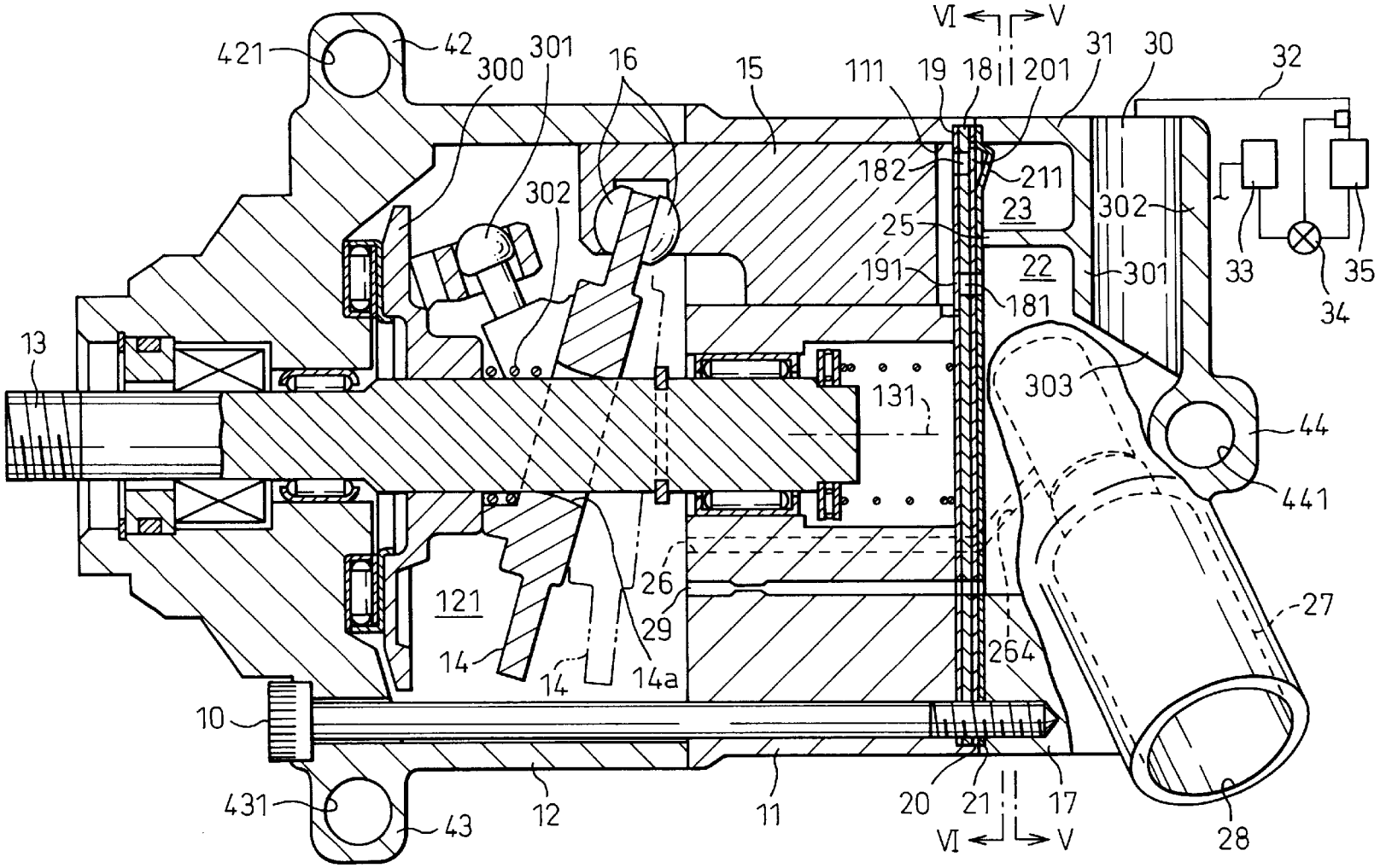
FIG. 2 is a sectional view of the compressor, taken along line II—II in FIG. 1.
Figure 3:
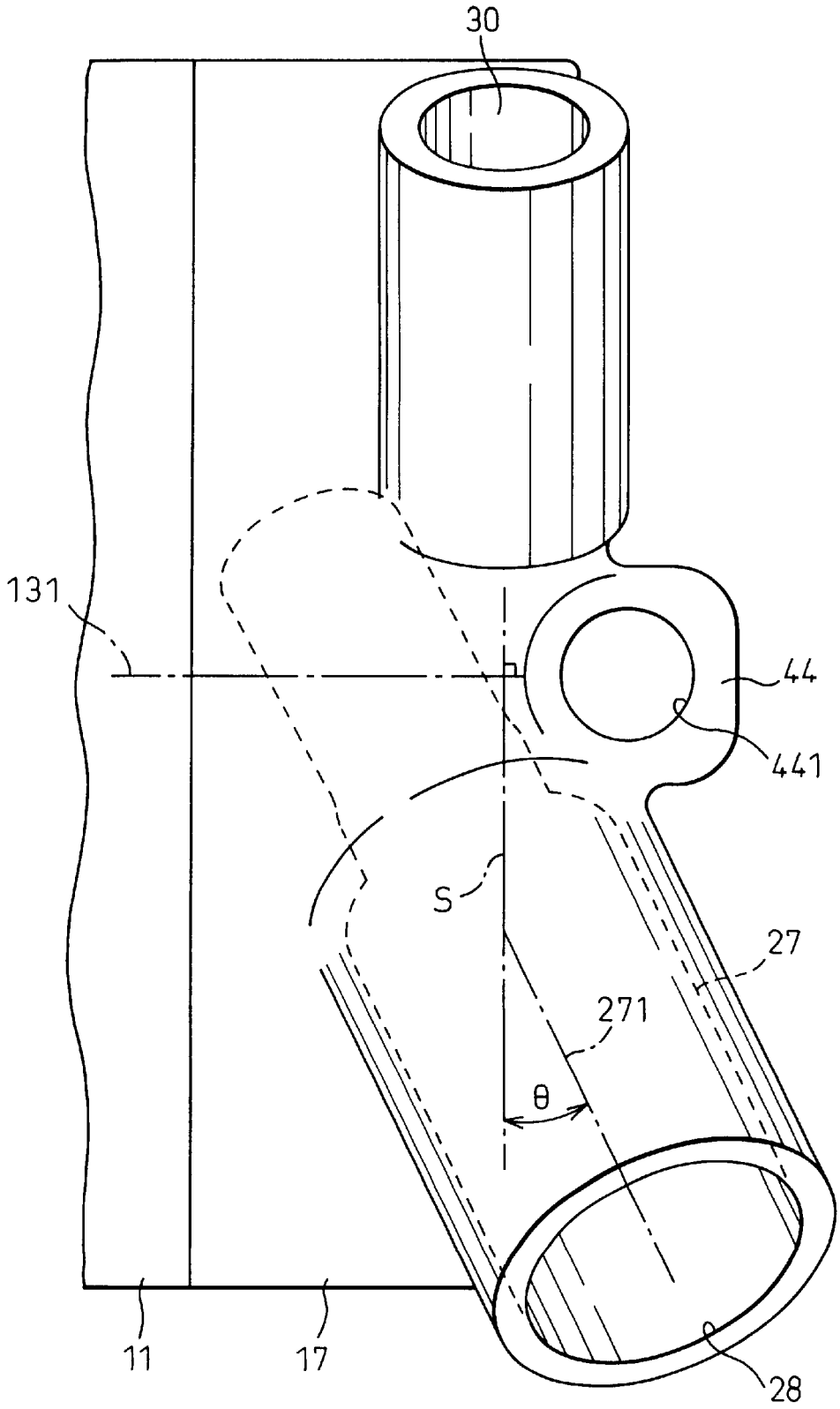
FIG. 3 is a side view of the main part of the compressor.

As shown in FIG. 2, the variable capacity type compressor includes a body comprising a cylinder block 11, a front housing 12, and a rear housing 17. A rotary shaft 13 is supported by the front housing 12 and the cylinder block 11 and receives a rotational driving force from the vehicle engine (not shown). The front housing 12 forms a control pressure chamber (crank chamber) 121. A swash plate 14 is supported by the rotary shaft 13 in the control pressure chamber 121 so that the swash plate 14 is axially movable and tiltable with respect to the rotary shaft 130. The swash plate 14 has a central hole 14*a* having a curved inner wall. The swash plate 14 is rotatable with the rotary shaft 13, by the provision of a rotor 300 and a hinge 301. A spring 302 biases the swash plate 14. A plurality of cylinder bores 111 (six in this embodiment) are provided in and through the cylinder block 11 in the peripheral region thereof and around the rotary shaft 13. Pistons 15 are accommodated in the respective cylinder bores 111. The rotational movement of the drive shaft 13 is converted to forward/rearward reciprocating movements of the pistons 15 via the swash plate 14 and shoes 16.

Figure 1:
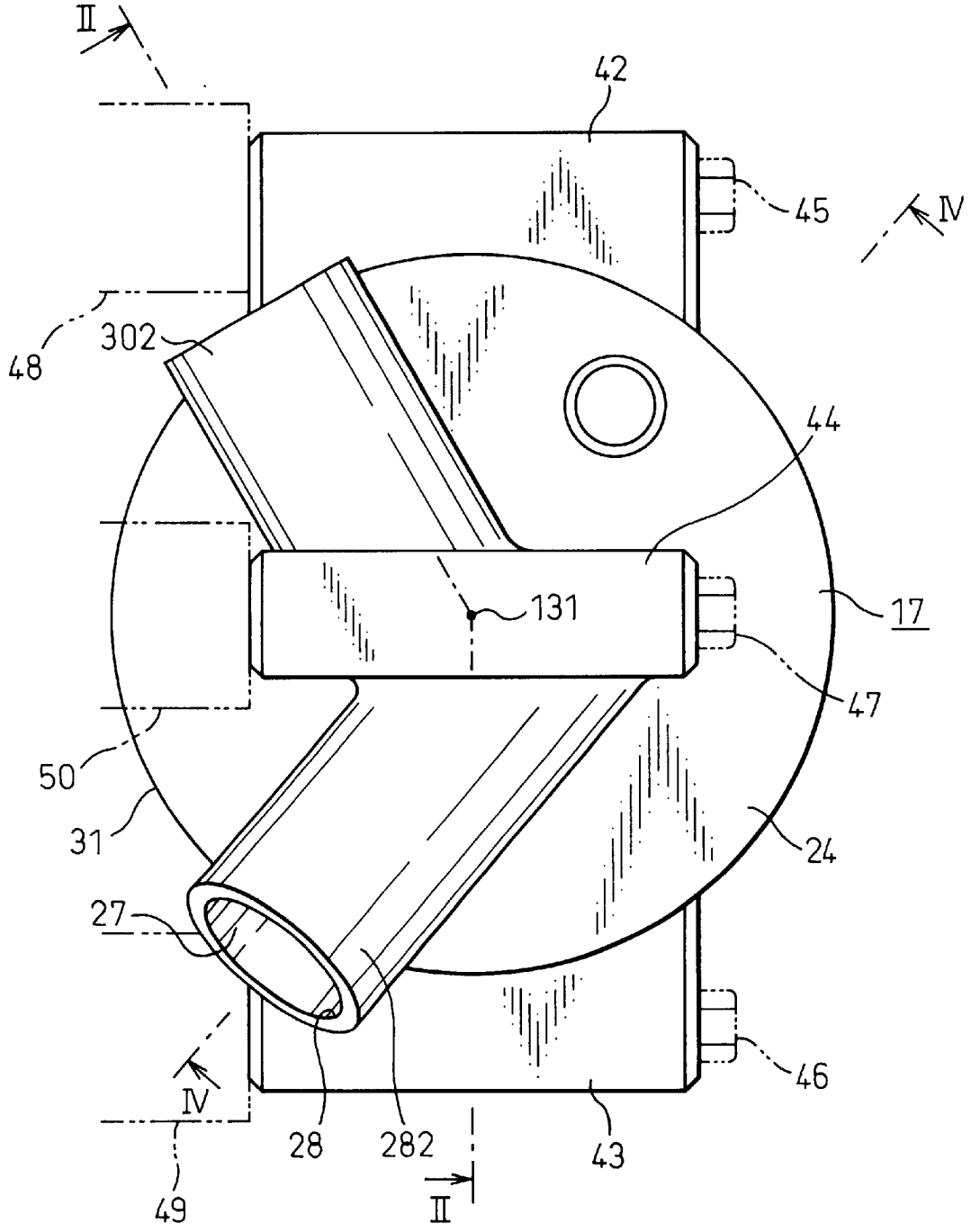
FIG. 1 is a rear view of a compressor according to the first embodiment of the present invention.
Figure 4:
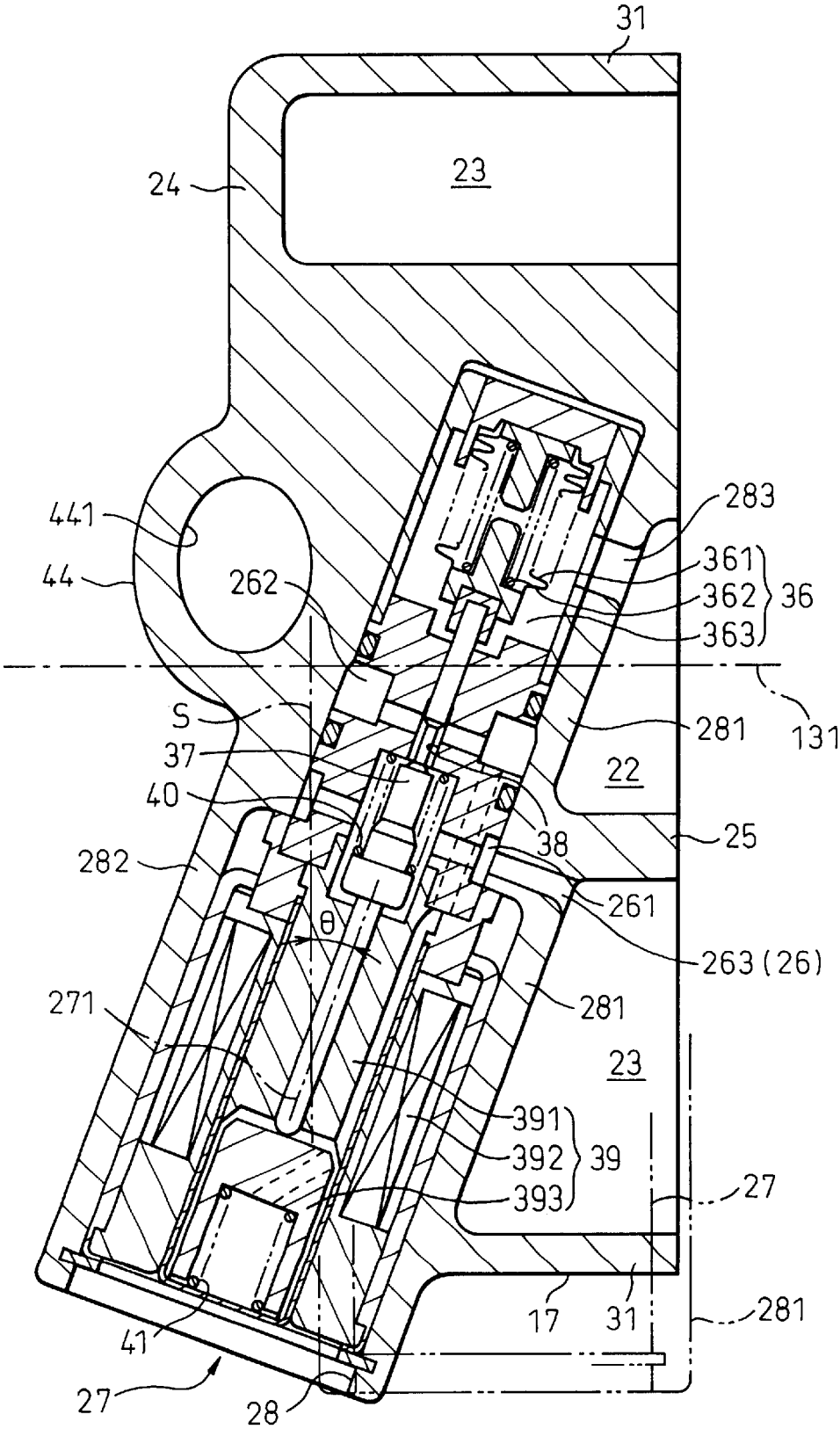
FIG. 4 is a sectional view of the compressor, taken along line IV—IV in FIG. 1.
Figure 5:
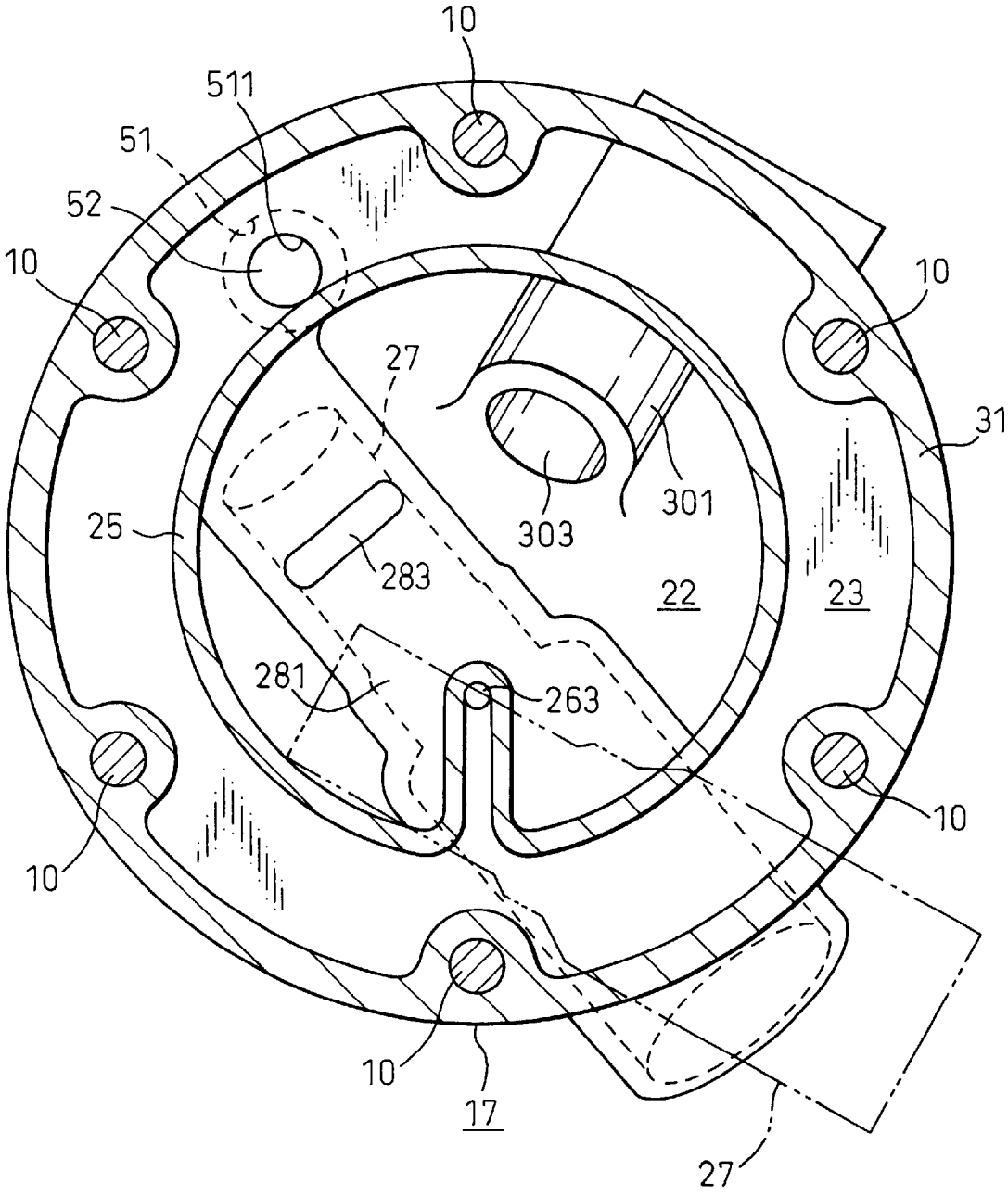
FIG. 5 is a sectional view of the compressor, taken along line V—V in FIG. 2.

The rear housing 17 is fixed to the cylinder block 11 via a valve plate 18, valve-forming plates 19 and 20 and a retainer-forming plate 21. The cylinder block 11, the front housing 12 and the rear housing 17 are secured to each other by a plurality of bolts 10 (six in this embodiment). The rear housing 17 has a suction chamber 22 and a discharge chamber 23 defined therein. The rear housing 17 has an end wall 24, as shown in FIGS. 1 and 4. The suction chamber 22 and the discharge chamber 23 are sectioned by an annular partitioning wall 25 perpendicularly extending from the end wall 24 of the rear housing 17, so that the suction chamber 22 is at the central region and the discharge chamber 23 is at the peripheral region and encircles the suction chamber 22 as shown in FIGS. 5 and 6.

Figure 6:
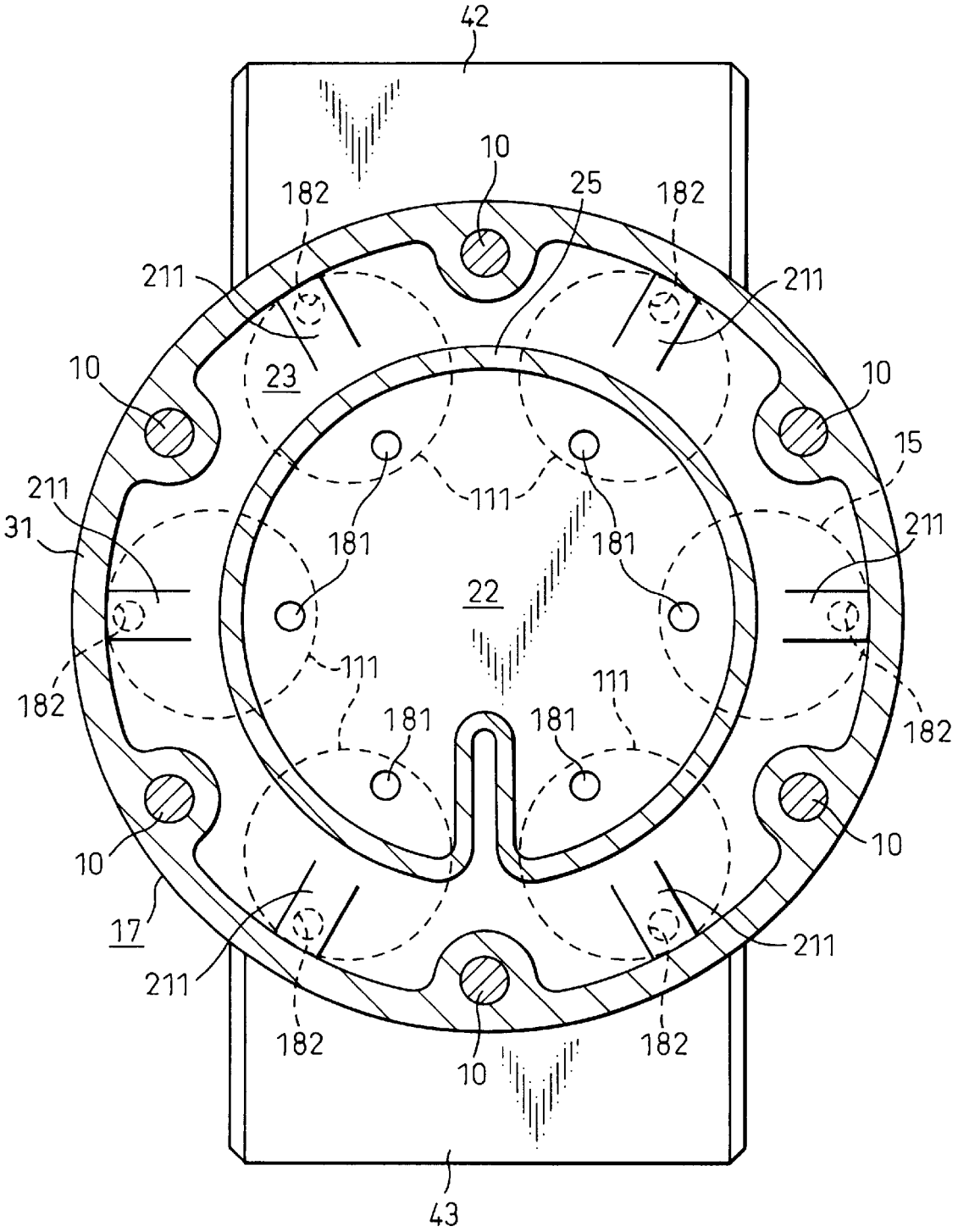
FIG. 6 is an enlarged sectional view of the compressor, taken along line VI—VI in FIG. 2.

Suction ports 181 are provided in the valve plate 18 on the inner side of the partitioning wall 25, which forms the side wall of the suction chamber 22, in correspondence to the respective cylinder bores 111 as shown in FIG. 6. Discharge ports 182 are provided in the valve plate 18 on the outer side of the partitioning wall 25 in correspondence to the respective cylinder bores 111. Suction valves 191 are formed in the valve-forming plate 19, and discharge valves 201 are formed in the valve-forming plate 20. The suction valves 191 open and close the suction ports 181, and the discharge valves 201 open and close the discharge ports 182.

A coolant inlet passage 30 is provided in the end wall 24 of the rear housing 17. The coolant inlet passage 30 has an inside wall 301, an outside wall 302, and an communication hole 303, as shown in FIG. 2. The inside wall 301 of the coolant inlet passage 30 protrudes toward the suction chamber 22 and the discharge chamber 23, and the outside wall 302 protrudes outward from the outer end surface of the end wall 24. The coolant inlet passage 30 extends from the circumferential wall 31 of the rear housing 17 across the discharge chamber 23 and the communication hole 303 communicates with the suction chamber 22.

An accommodation chamber 28 is formed in the end wall 24 of the rear housing 17 as shown in FIGS. 1, 2 and 4. The accommodation chamber 28 has an inside wall 281 and an outside wall 282, as shown in FIG. 4. The inside wall 281 of the accommodation chamber 28 protrudes toward the suction chamber 23 and the discharge chamber 22, and the outside wall 282 of the accommodation chamber 28 protrudes outward from the outer end surface of the end wall 24. An extension of the coolant inlet passage 30 intersects the inside wall 281 of the accommodation chamber 28. The proximal end portions (axially outer end portions) of the inside wall 281 and the outside wall 282 extend outward from the circumferential wall 31 of the rear housing 17.

Coolant in the suction chamber 22 defining a suction pressure zone is sucked in the cylinder bore 111 through the suction port 181, opening the suction valve 191 during the backward motion of the piston 15. Coolant in the cylinder bore 111 is discharged from the cylinder bore 111 through the discharge port 182 into the discharge chamber 23 defining the discharge pressure zone, opening the discharge valve 201 during the forward motion of the piston 15. The degree of opening of the discharge valve 201 is restricted by a retainer 211 on the retainer-forming plate 21. Coolant in the discharge chamber 23 is recirculated through an exterior coolant circuit 32 including a condenser 33, an expansion valve 34, and an evaporator 35 and returns to the suction chamber 22 through the coolant inlet passage 30.

Figure 7:
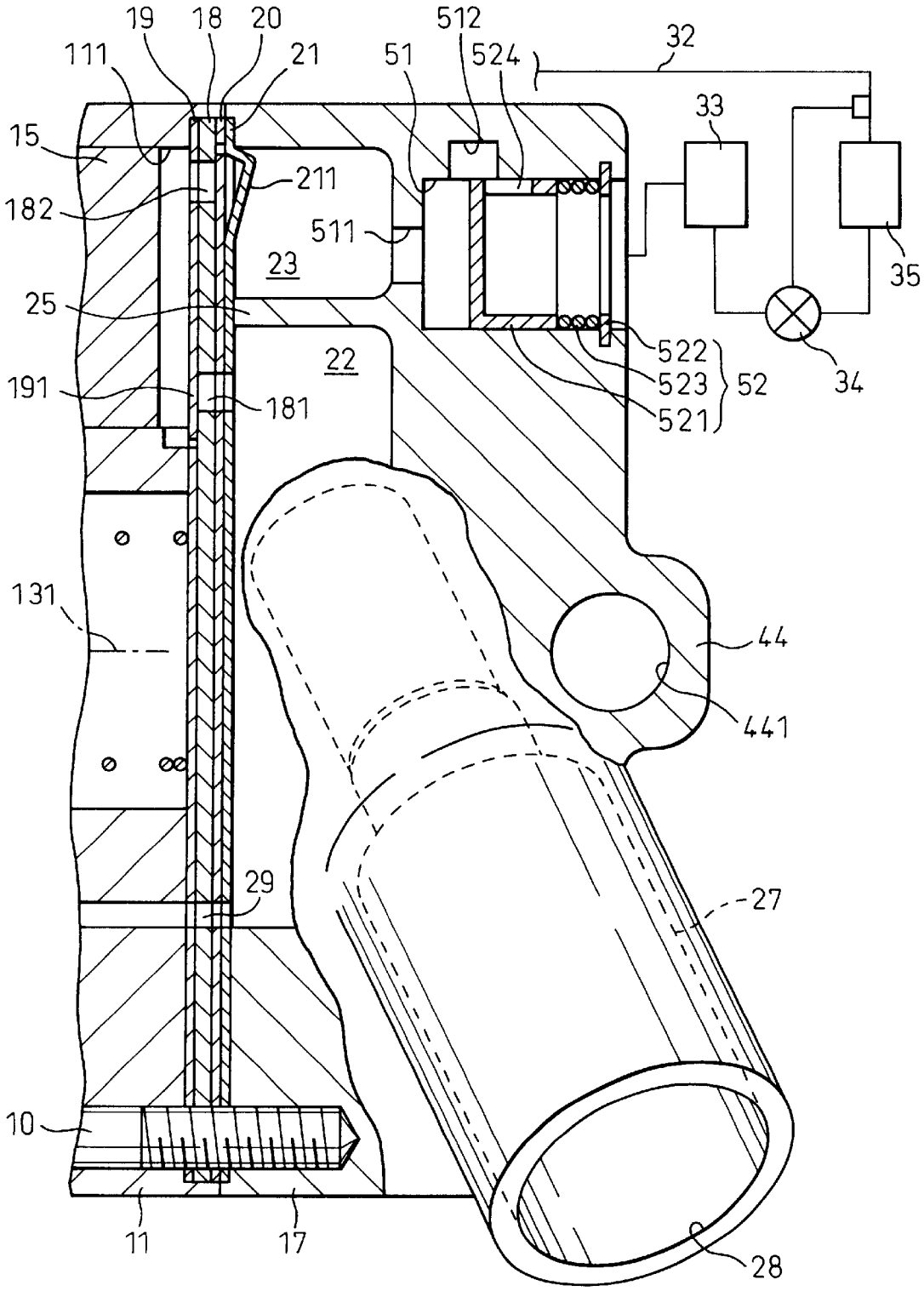
FIG. 7 is a sectional view of the discharge on-off valve.

As shown in FIG. 7, a discharge shut-off valve 52 is provided in a discharge passage 51. The discharge shut-off valve 52 comprises a tubular valve body 521 accommodated in the discharge passage 51 in a slidable manner, a circlip 522 attached to the inner wall of the discharge passage 51, and a compression spring 523 interposed between the circlip 522 and the valve body 521. The valve body 521 opens and closes a valve hole 511 while being biased by the compression spring 523 which acts to close the valve hole 511. A detour 512 is provided in the inner wall of the discharge passage 51 at a position between the valve hole 511 and the circlip 522 and is connected to the discharge passage 51. The detour 512 forms a part of the discharge passage 51. An opening 524 is provided in the circumferential surface of the tubular valve body 521. When the valve body 521 is at an open position shown in FIG. 7, coolant gas in the discharge chamber 23 can flow out to the exterior coolant circuit 32, through the valve hole 511, the detour 512, the opening 524 and the tubular valve body 521. If the valve body 521 closes the valve hole 511, the coolant gas in the discharge chamber 23 is prevented from flowing out to the exterior coolant circuit 32.

A capacity control solenoid valve 27 is accommodated in the accommodation chamber 28. The capacity control valve 27 is arranged in a coolant supply passage 26 which connects the discharge chamber 23 to the control pressure chamber 121. The coolant supply passage 26 supplies the coolant in the discharge chamber 23 to the control pressure chamber 121. A solenoid 39 of the capacity control valve 27 is controlled by a controller (not shown) and energized and disenergized, wherein the controller controls the capacity control valve 27 so that a target temperature in the compartment in the vehicle preset by a compartment temperature setting device (not shown) is attained based on a temperature detected in the compartment by a compartment temperature sensor (not shown).

As shown in FIG. 4, the capacity control valve 27 has a pressure sensitive means 36 including a bellows 361 as a pressure sensitive member, a pressure sensitive spring 362, and a pressure sensitive chamber 363. The interior pressure of the suction chamber 22 (suction pressure) is applied to the pressure sensitive chamber 362 to act on the bellows 361. The suction pressure in the suction chamber 22 reflects a thermal load. The capacity control valve 27 has a valve member 37 and a valve hole 38, which is part of the coolant supply passage 26. The valve member 37 is coupled to the bellows 361, for opening and closing the valve hole 38. The atmospheric pressure within the bellows 361 and the elastic force of the pressure sensitive spring 362 are applied to the valve member 37 in the direction to open the valve hole 38. The capacity control valve 27 also has a solenoid 39 including a stator core 391, a coil 392, and an armature core 393. The stator core 391 attracts the armature core 393 due to the excitation of the coil 392 by the current supply thereto. That is, the electromagnetic driving force of the solenoid 39 biases the valve member 37 to close the valve 38 against the elastic force of a spring 40 which acts in the valve opening direction. A spring 41 biases the armature core 393 toward the stator core 391. The opening degree of the valve hole 38 is determined by the balance between the electromagnetic force generated by the solenoid 39, the elastic force of the spring 41, the elastic force of the spring 40 and the biasing force of the pressure-sensitive means 36, and the capacity control valve 27 controls the suction pressure in accordance with a current value supplied to the solenoid 39.

As the supplied current value increases, the opening degree of the valve is decreased to reduce the amount of coolant supplied from the discharge chamber 32 to the control pressure chamber 121. Since coolant in the control pressure chamber 121 is flowing out to the suction chamber 22 through a coolant outlet passage 29, the pressure in the control pressure chamber 121 lowers. The inclination angle of the swash plate 14 depends on a difference between the pressure in the control pressure chamber 121 acting on one end of the pistons 15 and the suction pressure acting on the other end of the pistons 15. Accordingly, the inclination angle of the swash plate 14 becomes greater to increase the discharge capacity. The increase in the discharge capacity results in the decrease in the suction pressure. Contrarily, if the supplied current value lowers, the opening degree of the valve increases to increase the amount of coolant supplied from the discharge chamber 23 to the control pressure chamber 121. Accordingly, the pressure in the control pressure chamber 121 increases to decrease the inclination angle of the swash plate 14, resulting in the reduction in the discharge capacity. The reduction in the discharge capacity causes the suction pressure to increase.

If the current supplied to the solenoid 39 becomes zero, the opening degree of the valve becomes maximum to cause the inclination angle of the swash plate 14 to be minimum as shown in FIG. 2. The discharge pressure is low when the inclination angle of the swash plate 14 is minimum. The elastic force of the compression spring 523 is selected so that the pressure in the region of the discharge passage 51 upstream from the discharge shut-off valve 52 in the above-mentioned state is lower than the sum of the pressure in a region downstream from the discharge shut-off valve 52 and the elastic force of the compression spring 523. Therefore, when the inclination angle of the swash plate 14 becomes minimum, the valve body 521 closes the valve hole 511 to interrupt the circulation of coolant in the exterior coolant circuit. If the circulation of the coolant is interrupted, the operation for reducing the thermal load is made to stop.

The minimum inclination angle of the swash plate 14 is slightly greater than 0 degree. Since the minimum inclination angle of the swash plate 14 is not zero degrees, the discharge of coolant gas from the cylinder bore 111 to the discharge chamber 23 continues even in a state wherein the inclination angle of the swash plate is minimum. The coolant gas discharged from the cylinder bore 111 to the discharge chamber 23 flows into the control pressure chamber 121 through the coolant supply passage 26. The coolant gas within the control pressure chamber 121 flows into the suction chamber 22 through the coolant outlet passage 29, while the coolant gas within the suction chamber 22 is sucked in the cylinder bore 111 and then discharged to the discharge chamber 23. That is, when the inclination angle of the swash plate is minimum, a circulation path is established in the compressor through the discharge chamber 23, the coolant supply passage 26, the control pressure chamber 121, the coolant outlet passage 29, the suction-chamber 22 defining the suction pressure zone and the cylinder bore 111. A pressure difference is generated between the discharge chamber 23, the control pressure chamber 121 and the suction chamber 22. Accordingly, the coolant gas circulates through the above-mentioned circulation path whereby a lubricant flowing together with the coolant gas lubricates the interior of the compressor.

When the current is supplied again to the solenoid 39, the opening degree of the valve becomes smaller to lower the interior pressure of the control pressure chamber 121. Thus, the inclination angle of the swash plate 14 increases from the minimum inclination angle. As the inclination angle of the swash plate 14 increases from the minimum inclination angle, the pressure upstream from the discharge shut-off valve 52 in the discharge passage 51 exceeds the sum of the pressure downstream from the discharge shut-off valve 52 and the elastic force of the compression spring 523. Accordingly, if the inclination angle of the swash plate 14 becomes greater than the minimum inclination angle, the valve hole 511 opens to allow the coolant gas in the discharge chamber 23 to flow out to the exterior coolant circuit 32.

As shown in FIG. 2, mounting members 42 and 43 are formed integrally with the upper and lower portions of the circumferential wall of the front housing 12, respectively. The mounting members 42 and 43 have bolt holes 421 and 431 bored perpendicular to the plane of the drawing, respectively. Both the bolt holes 421 and 431 are parallel to each other. As apparent from FIGS. 1, 2 and 3, a mounting member 44 is formed integrally with the end wall 24 of the rear housing 17 at the outer end surface thereof. A bolt hole 441 is formed in the mounting member 44 perpendicular to the axis of rotation 131 and parallel to the bolt holes 421 and 431.

As shown in FIG. 1, the mounting members 42, 43 and 44 are fastened to bosses 48, 49 and 50 of the vehicle engine by tightening bolts 45, 46 and 47 inserted through the bolt holes 421, 431 and 441, respectively.

As shown in FIG. 4, the accommodation chamber 28 is positioned obliquely to the axis of rotation 131. That is, it is adapted so that an angle θ between the center axis 271 of the capacity control valve 27 accommodated in the accommodation chamber 28 and the plane S perpendicular to the axis of rotation 131 is not zero. The distal end of the accommodation chamber 28 extends under the bolt hole 441 or the mounting member 44 so that the distal end of the accommodation chamber 28 is away from the outer end surface of the end wall 24 of the rear housing 17, as seen from the outer end surface of the end wall 24 of the rear housing 17 in the direction of the axis of rotation 131 of the rotary shaft 13. As is apparent from FIGS. 4 and 5, the inside wall 281 of the distal end of the accommodation chamber 28 is arranged in the suction chamber 22 and the pressure-sensitive means 36 is arranged in the distal end of the accommodation chamber 28. The pressure-sensitive chamber 363 communicates with the suction chamber 22 via a pressure sensitive opening 283 in the inside wall 281.

The first embodiment involves the following effects.

(1-1) Generally, the outer diameter of a portion of the capacity control valve 27 including the solenoid 39 is greater than that of a portion of the capacity control valve 27 including the pressure-sensitive means 36. If the capacity control valve 27 is not inclined with respect to the plane S perpendicular to the axis of rotation 131, as indicated by a chain dot line in FIG. 4, and the distal end of the capacity control valve 27 is arranged under the bolt hole 441 of the bracket 44 while the inside wall 281 of the accommodation chamber 28 would be protrudent from the discharge chamber 23 to the cylinder block 11. Although a protrusion might be avoidable by prolonging the length of the rear housing 17 in the direction of the axis of rotation 131, this results in the enlargement of the compressor size. It is possible to avoid the enlargement of the compressor size without inclining the capacity control valve 27, by causing the distal end of the capacity control valve 27 to not extend under the bolt hole 441 of the mounting member 44, as shown by a chain dot line in FIG. 5. However, since the mounting member 44, positioned perpendicular to the axis of rotation 131 of the rotary shaft 13, divides the outer end surface of the end wall 24 into two generally equal areas, there is a drawback in that the distal end of the capacity control valve 27 is largely away in the lateral direction from the radial center of the rear housing 17 (i.e., the axis of rotation 131) if the capacity control valve 27 does not extend under the bolt hole 441. In such a deviated arrangement, it is impossible to have a sufficient insertion length of the capacity control valve 27, whereby the proximal end of the capacity control valve 27 largely extends out of the circumferential wall 31 of the rear housing 17 in the lateral direction.

The inclined arrangement of the capacity control valve 27 relative to the plane S enables the distal end of the capacity control valve 27 to extend under the bolt hole 441 of the mounting member 44. Such an arrangement that the distal end of the capacity control valve 27 extends under the bolt hole 441 allows the distal end of the capacity control valve 27 to approach the radial center of the rear housing 17 (the axis of rotation 131), and to prolong the insertion length of the capacity control valve 27. Accordingly, the inclined arrangement of the capacity control valve 27 relative to the plane S extending perpendicular to the axis of rotation 131 is effective for restricting the protrusion of the capacity control valve 27 out of the circumferential wall 31 of the rear housing 17.

(1-2) The suction chamber 22 is located on the radially central side of the rear housing 17, and the discharge chamber 23 encircles the suction chamber 22. The pressure sensitive means 36, located closer to the distal end of the volumetric control valve 27, operates so that the suction pressure within the pressure sensitive chamber 363 converges to a predetermined pressure value corresponding to the driving force of the solenoid 39 which constitutes the electrical drive means. The pressure sensitive means 36 acts in responsive to the suction pressure of the suction chamber 22. The inclined arrangement of the capacity control valve 27 enables the inside wall 281 of the distal end of the accommodation chamber 28 to largely advance toward the center of the suction chamber 22. If the distal end of the inside wall 281 largely advances toward the center of the suction chamber 22, the area of the distal end of the inside wall 281 exposed to the suction chamber 22 increases to enlarge a pressure sensitive opening 283 connecting the pressure sensitive chamber 363 to the suction chamber 22. The larger pressure sensitive opening 283 is capable of quickly transmitting the pressure variation in the suction chamber 22 to the pressure sensitive chamber 363 to facilitate the sensitivity of the pressure sensitive means 36.

(1-3) The suction chamber 22 has a function to suppress the suction pulsations, so that the larger the suction chamber 22, the higher the effect of suppressing the suction pulsations. The pressure sensitive opening 283, having a larger area, aids in the function of the suction chamber 22 to suppress the suction pulsation.

(1-4) Annular passages 261 and 262 are formed between the circumferential surface of the capacity control valve 27 accommodated in the accommodation chamber 28 and the walls 281 and 282 of the accommodation chamber 28, as shown in FIG. 4. The annular passage 261 and 262 constitute part of the coolant supply passage 26. A passage 263 connects the discharge chamber 23 to the annular passage 261, and a passage 264 connects the annular passage 262 to the pressure control chamber 121. The annular passages 261 and 262 are connected to each other. The wider the width of the annular passages 261 and 262, the easier the connection of the annular passages 261 and 262 with passages 263 and 264. According to this embodiment capable of prolonging the insertion length of the capacity control valve 27, it is possible to increase the entire length of the capacity control valve 27 so that the wider annular passages 261 and 262 are obtainable while restricting the outward protrusion of the capacity control valve 27 from the circumferential wall 31 of the rear housing 17.

(1-5) The coolant inlet passage 30, which straightly guides the coolant from the exterior coolant circuit 32 outside the compressor into the suction chamber 22 within the compressor, suppresses the pressure loss in the suction passage in the compressor extending from the outside of the compressor to the suction chamber 22. The suppression of the pressure loss in the suction passage extending from the outside of the compressor to the suction chamber 22 contributes to a smooth sucking of coolant into the cylinder bores 111 to improve the volumetric efficiency regarding the coolant. The inside wall 281 of the accommodation chamber 28 protruding toward the suction chamber 22 intersects the extension of the coolant inlet passage 30 whereby the coolant flowing from the coolant inlet passage 30 into the suction chamber 22 is deflected to the valve plate 18 by means of the inside wall 281. The deflecting action of the inside wall 281 to the coolant contributes to smoothing the coolant flow from the exit 303 of the coolant inlet passage 30 to the suction port 181, wherein the deflecting action is more effective as the inside wall 281 is closer to the center of the suction chamber 22. The inclined arrangement of the capacity control valve 27 contributes to smoothing the coolant flow from the exit 303 of the coolant inlet passage 30 to the suction port 181.

Figure 8:
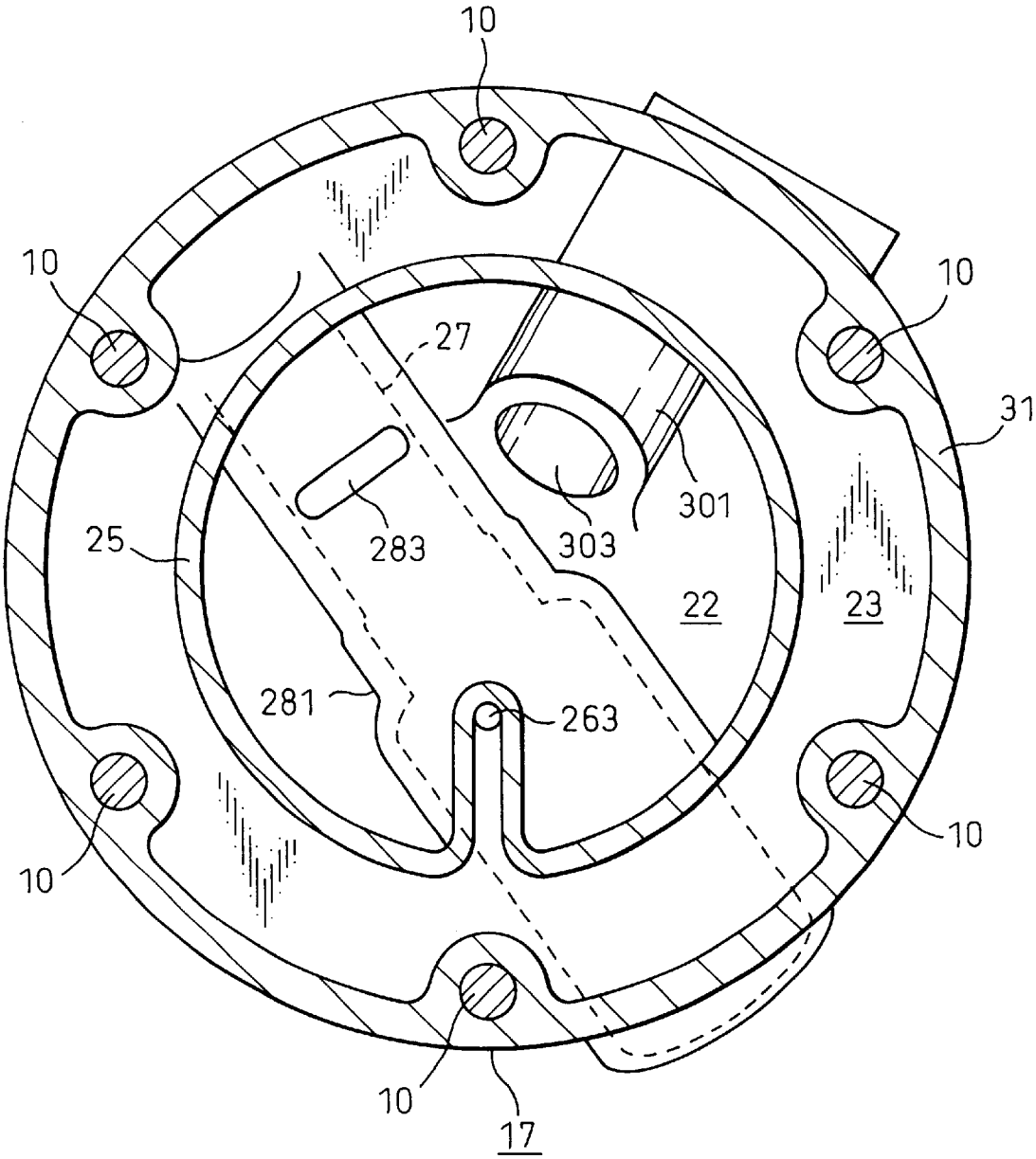
FIG. 8 is a sectional view of a compressor according to the second embodiment of the present invention.

The second embodiment of the present invention will be described below with reference to FIG. 8 wherein the same reference numerals are used for denoting the same or similar parts as in the first embodiment.

This embodiment lacks the discharge shut-off valve 52 used in the first embodiment, which allows the capacity control valve 27 to further approach the axis of rotation 131. As a result, the insertion length of the capacity control valve 27 can be longer than that in the first embodiment to reduce the protrusion of the proximal end of the capacity control valve 27 outward from the circumferential wall 31 of the rear housing 17.

The following modifications can be considered within the present inventions.

(1) To extend the capacity control valve 27 under the coolant inlet passage 30 as viewed from the end wall 24 of the rear housing 17 in the direction of the axis of rotation 131.

(2) To apply the present invention to a variable capacity type compressor provided with a capacity control valve in the coolant outlet passage 29 for releasing the coolant from the control pressure chamber 121 to the suction chamber 22.

(3) To apply the present invention to a variable capacity type compressor incorporating, for example, a three-way valve as a sole capacity control valve for controlling the supply of coolant from the discharge chamber to the control pressure chamber and the release of coolant from the control pressure chamber into the suction chamber.

(4) To apply the present invention to a variable capacity type compressor provided with a capacity control valve having no electrical drive means.

As described in detail above, according to the present invention, since the capacity control valve is inclined relative to a plane perpendicular to the axis of rotation of the rotary shaft of the compressor, it is possible to restrict the protrusion of the capacity control valve outward, from the circumferential wall of the rear housing, in comparison with the prior art.

What is claimed is:

1. A variable capacity type compressor comprising:

a body comprising a cylinder block having cylinder bores, and a rear housing attached to said cylinder block and having a discharge chamber and a suction chamber for communication with said cylinder bores, said rear housing having a circumferential wall and an outer end surface on the side opposite from said cylinder block;

pistons reciprocatingly arranged in the cylinder bores so that the movement of said piston toward said rear housing causes the coolant to be discharged from said cylinder bore into said discharge chamber and the movement of said piston away from said rear housing causes the coolant to be sucked from said suction chamber to said cylinder bore;

a rotatable drive shaft having an axis;

a motion transmitting device driven by said drive shaft for converting the rotational movement of the drive shaft into the reciprocating movement of the pistons;

a control pressure chamber connected to a discharge pressure region by a coolant supply passage and to a suction pressure region by a coolant outlet passage; and a capacity control valve mounted to the rear housing in an inclined position relative to a plane perpendicular to the axis of the rotatable drive shaft, said capacity control valve being arranged in one of said coolant supply passage and said coolant outlet passage to control the pressure in said control pressure chamber to thereby control the capacity of said compressor.

2. A variable capacity type compressor according to claim 1, further comprising a mounting member provided integral with or on said rear housing for mounting said compressor to an object to which said compressor is to be mounted, said mounting member being arranged along the outer end surface of said rear housing, said capacity control valve having a proximal end located near said circumferential wall of said rear housing and a distal end located close to the axis of the rotatable drive shaft, said capacity control valve being inclined so that the distance from said distal end to the outer end surface of said rear housing is greater than the distance from said proximal end to the outer end surface of said rear housing, and intersecting said mounting member, as viewed in the direction of the axis of said rotatable drive shaft.

3. A variable capacity type compressor according to claim 2, wherein said mounting member perpendicularly intersects said axis of said rotatable drive shaft, and a part of said capacity control valve is arranged under said mounting member.

4. A variable capacity type compressor according to claim 2, further comprising a straight coolant suction passage arranged in the rear housing and connected to the suction chamber, said coolant suction passage being arranged on one side of said mounting member, said capacity control valve being arranged on the other side of said mounting member.

5. A variable capacity type compressor according to claim 1, wherein said suction chamber is formed at a radially central region in the rear housing and said discharge chamber encircles said suction chamber, and wherein said capacity control valve comprises a valve member, an electrical drive means for said valve member, and a pressure sensitive device having a pressure sensitive chamber communicating with said suction chamber, and a pressure sensitive member displaceable in response to the pressure variation in said pressure sensitive chamber, said pressure sensitive device being arranged on the side of said distal end of said capacity control valve, said pressure sensitive device functioning so that the pressure in said pressure sensitive chamber converges to a pressure value corresponding to the driving force of said electrical drive means.

6. A variable capacity type compressor according to claim 5, wherein said electrical drive means comprises a solenoid.

7. A variable capacity type compressor according to claim 1, further comprising a front housing attached to said cylinder block on the side opposite from said rear housing, said front housing and said cylinder block forming said control pressure chamber, said motion transmitting device comprising a swash plate arranged in said control pressure chamber and axially movably and tiltably attached to said rotatable drive shaft, a rotor attached to said rotatable drive shaft and hinged to said swash plate to allow the swash plate to rotate with the rotatable drive shaft, and shoes arranged between the swash plate and the pistons.

* * * * *